US005276379A

United States Patent [19]

Haraden et al.

[11] Patent Number: 5,276,379

[45] Date of Patent: Jan. 4, 1994

[54] ARC DISCHARGE LAMP HAVING CEMENTLESS BASE MEMBERS

[75] Inventors: Thomas Haraden, Hamilton; Harold L. Hough, Beverly, both of Mass.

[73] Assignee: GTE Products Corporation, Danvers, Mass.

[21] Appl. No.: 837,792

[22] Filed: Feb. 18, 1992

[51] Int. Cl.[5] ..... H01J 61/30

[52] U.S. Cl. ..... 313/493; 313/51; 313/318; 313/323; 313/623; 313/631

[58] Field of Search ..... 313/318, 51, 572, 323, 313/612, 613, 614, 617, 619, 493, 634, 623; 439/611, 612, 602; 220/2.1

[56] References Cited

U.S. PATENT DOCUMENTS

| | | | |
|---|---|---|---|
| 3,265,917 | 8/1966 | Ray | 313/109 |
| 3,993,386 | 11/1976 | Rowe | 439/236 |
| 4,105,910 | 8/1978 | Evans | 313/490 |
| 4,221,453 | 9/1980 | Wagener | 439/612 |
| 4,473,770 | 9/1984 | Baba et al. | 313/318 |
| 4,495,440 | 1/1985 | Schlitt et al. | 313/492 |
| 4,603,278 | 7/1986 | Devir et al. | 313/318 |
| 4,752,710 | 6/1988 | Devir et al. | 313/318 |

*Primary Examiner*—Donald J. Yusko
*Assistant Examiner*—Ashok Patel
*Attorney, Agent, or Firm*—Carlo S. Bessone

[57] ABSTRACT

An arc discharge lamp including an electrically insulative base member securely positioned at opposite ends of the lamp without the need for basing cements or the like. The base member includes at least one internally-protruding segment for positioning within a detent formed in the press seal region of the lamp. The base member functions to securedly retain the external portions of the lamp's electrical leads in a predetermined alignment.

7 Claims, 3 Drawing Sheets

ARC DISCHARGE LAMP HAVING CEMENTLESS BASE MEMBERS

CROSS-REFERENCE TO RELATED APPLICATIONS

This application, which discloses and claims structural features for a low-pressure arc discharge lamp, relates to subject matter disclosed and claimed in the following copending applications, which are assigned to the assignee of the present application and are hereby incorporated by reference:

U.S. Ser. No. 07/837,790 (now U.S. Pat. No. 5,210,461) of Robert Y. Pai et al filed concurrently herewith and entitled "ARC DISCHARGE LAMP CONTAINING MECHANISM FOR EXTINGUISHING ARC AT END-OF-LIFE", U.S. Ser. No. 07/547,942 (now U.S. Pat. No. 5,116,272) of Ronald G. Blaisdell et al filed Jul. 3, 1990 and entitled "METHOD AND APPARATUS FOR FORMING APERTURES IN FLUORESCENT LAMPS", and U.S. Ser. No. 07/547,984 (now U.S. Pat. No. 5,142,191) of Ronald G. Blaisdell et al filed Jul. 3, 1990 and entitled "APERTURE FLUORESCENT LAMP WITH PRESS SEAL CONFIGURATION".

FIELD OF THE INVENTION

This invention relates to the field of low-pressure arc discharge lamps. More particularly, the invention relates to low-pressure arc discharge lamps, such as subminiature fluorescent lamps, containing a structure or device which renders the lamp inoperable at the end of its useful life. The invention further relates to arc discharge lamps having base members that do not require affixing cements.

BACKGROUND OF THE INVENTION

Herein, the terms "end-of-life" and "end of the useful life" of a low-pressure arc discharge lamp are defined as that time when the electron-emissive material on one electrode filament has been depleted causing the arc discharge to destroy the filament and/or strike other parts of the electrode mount structure.

Low-pressure arc discharge lamps, such as fluorescent lamps, are well known in the art and typically include a pair of electrodes made of a coil of tungsten wire upon which is deposited a coating of an electron-emissive material consisting of alkaline metal oxides (BaO, CaO, SrO) to lower the work function of the cathode and thus improve lamp efficiency. With electron-emissive material disposed on the electrode filament, the cathode fall voltage is typically about 13 volts. However, at the end of the useful life of the lamp when the electron-emissive material on one of the electrode filaments becomes depleted, the cathode fall voltage rises by 100 volts or more. If the external circuitry fails to limit the open circuit voltage across the lamp, the lamp may continue to operate with the additional power being deposited at the lamp electrode region. By way of example, a lamp which normally operates at 0.1 amp would deposit 0.65 watt at each electrode during normal operation. At end-of-life, the depleted electrode may consume 7.5 watts due to the increase in cathode fall voltage. This extra power can lead to excessive local heating of the lamp and fixture.

Low-pressure arc discharge lamps, especially those designed for operation at high current (1.5 amp) loading, such as very high output (VHO) lamps, sometimes fail by causing the fracture of the glass envelope. It is believed the sequence of events leading to such failures is as follows. At the end of the useful life of the lamp, the electron-emissive material on one of the electrode filaments becomes depleted. When such depletion occurs, the arc discharge strikes other components of the electrode structure and, in particular, the arc strikes the electrical leads supporting the electrode structure. The electrical leads are heated by the arc to the point where the wires soften and bend. Subsequently, the electrical leads and the electrode structure sag and come in contact with the glass envelope. The severe heat generated by the arc and the heated electrode structure cause the glass envelope to fracture.

Various internal structures for low-pressure arc discharge lamps have been proposed which cause the lamp to fail without fracture of the glass envelope. Such structures are suggested in the following references.

U.S. Pat. No. 3,265,917, which issued to Ray on Aug. 9, 1966, discloses a structure comprising a wire or conductive coating electrically connected to the inside portion of the electrode structure and extending to a thin-walled portion of the glass stem press. Upon depletion of the electron-emissive material on the electrode filament, the arc strikes and follows the conductive path reaching the thin-walled portion of the stem press. The heat generated by the arc and the heated conductor softens and melts the thin wall of the stem press to the point where the hermetic seal is lost. The introduction of the external atmosphere into the lamp extinguishes the arc discharge and renders the lamp inoperable.

U.S. Pat. No. 4,105,910, which issued to Evans on Aug. 8, 1978, discloses a structure providing for an auxiliary source of amalgam and for end-of-life extinguishment of the arc. This structure comprises a coating of a suitable amalgamative metal on portions of the stem press and the inside lead-in wire about the point where the lead-in wire emerges from the stem press.

U.S. Pat. No. 4,495,440, which issued to Schlitt et al, discloses an arc-extinguishing ampul mounted on each electrode structure. The ampul comprises a thin-walled glass body enclosing an arc-extinguishing gas, at least one electrically conductive support wire, and a heat-conductive coating covering the outer surface of the ampul and portions of the support wire. Upon depletion of the electron-emissive coating on one electrode filament at the end of the useful life of the lamp, the arc discharge is attracted to the ampul by the support wire. The heat of the arc softens and melts the ampul to the point where the arc-extinguishing gas within the ampul escapes and renders the lamp inoperable without loss of the lamp's hermetic seal.

Although the above-described end-of-life structures have been employed with varying degrees of success, it has been found that certain disadvantages do exist and such structures do leave something to be desired. More specifically, the above-described wire, conductive coating or amalgamative metal require a stem press mount configuration to implement. On the other hand, the arc-extinguishing ampul is rather expensive from a lamp-manufacturing standpoint because it adds additional manufacturing steps to the lamp process. Therefore, it would be very desirable and advantageous to have an end-of-life structure that does not require a stem press mount and which is more economical to utilize.

It is well known that arc discharge lamps, such as fluorescent lamps, generally include a base member disposed at each end of the lamp. Typically, each base members is affixed to respective ends of the lamp by means of a basing cement.

SUMMARY OF THE INVENTION

It is, therefore, an object of the present invention to obviate the disadvantages of the prior art.

It is another object of the invention to provide an improved arc discharge lamp.

It is a further object of the invention to provide an arc discharge lamp containing base members securely positioned at opposite ends of the lamp without the need for basing cements or the like.

These objects are accomplished in one aspect of the invention by the provision of an arc discharge lamp comprising a light-transmissive envelope having a tubular-shaped main body and a press seal disposed at each end of the main body. The main body of the envelope contains a fill material for supporting a low pressure discharge. A layer of phosphor is disposed on a surface within the main body of the envelope. An electrode filament is located at each end of the main body. A pair of electrical leads are attached to each electrode filament and sealed within a respective press seal. The arc discharge lamp further includes an insulative base member disposed at each end of the lamp. Each base member includes a tubular-shaped first portion having sidewalls and a flattened second portion protruding from one end of the first portion. One end of the first portion defines a first opening therein for receiving a press seal and has at least one protruding segment within the first opening projecting from an internal wall of the first portion and positioned within a detent formed in the press seal. The other end of the first portion of the base member defines an annular-shaped second opening for receiving a portion of the main body of the envelope adjoining the press seal. The first portion of the base member includes flexure means therein for enabling the sidewalls of the first portion to expand radially outwardly during positioning of the press seal within the first portion of the base member. The flattened second portion has a pair of apertures each located therewithin for receiving a respective one of the electrical leads from the lamp. The base member includes means for maintaining the externally protruding portion of each of the electrical leads in predetermined alignment against a respective external surface of the flattened second portion of the base member.

In accordance with further teachings of the present invention, the base member extends axially from the press seal and beyond the center of a respective electrode filament.

In accordance with further aspects of the present invention, the terminal end of the flattened second portion includes a positioning groove formed therein for receiving a portion of one of the electrical leads. The groove has a predetermined depth such that this portion of the electrical lead is flush with the terminal end of the flattened second portion. Preferably, the terminal end of the flattened second portion includes a pair of positioning grooves for receiving a portion of a respective electrical lead.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

Figure 1:
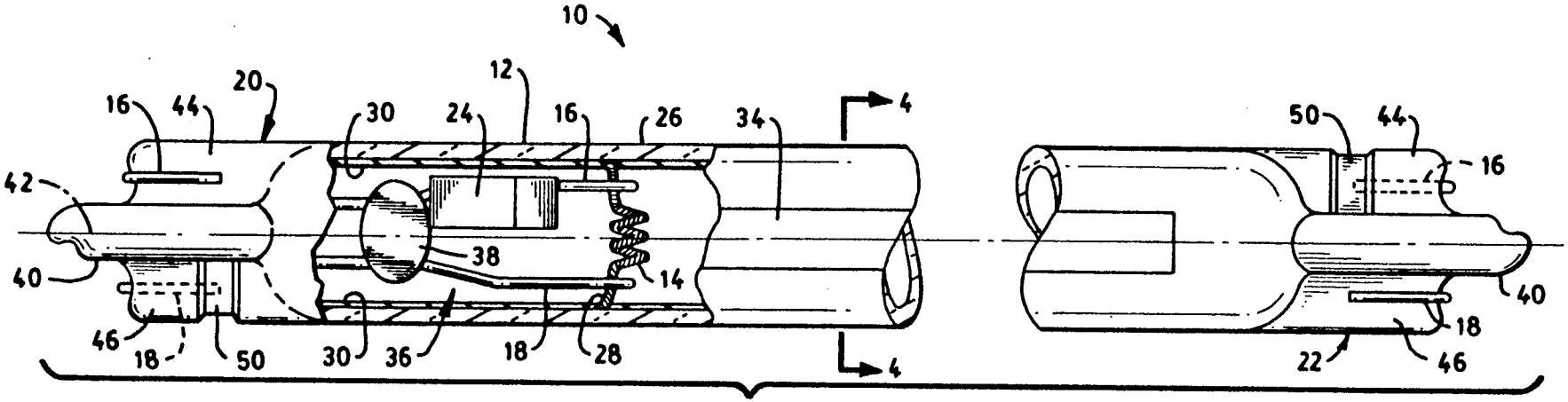
FIG. 1 is a plan view, partially in cross section, of one embodiment of an arc discharge lamp in accordance with the present invention.

For a better understanding of the present invention, together with other and further objects, advantages and capabilities thereof, reference is made to the following disclosure and appended claims in connection with the above-described drawings.

With particular attention to FIGS. 1–4, there is illustrated an improved low-pressure arc discharge lamp 10 (i.e., a fluorescent lamp) in accordance with the teachings of the invention. Lamp 10 generally includes a tubular-shaped light-transmissive envelope 12 having a tubular-shaped main body. Envelope 12 is typically fabricated of soda lime glass and, by the way of example, can have an outside diameter on the order of about 0.18 inch to 0.27 inch and a length in the range of 4–20 inches. An electrode filament 14 is mounted in each end of envelope 12. Electrical leads 16 and 18 are connected to filament 14 and extend through a press seal 20. A glass bead 38 formed on electrical leads 16 and 18 insures that a predetermined separation between the electrical leads is maintained during formation of the press seal. The opposite end of the lamp 10 is constructed in the same manner and includes a press seal 22. A mercury dispenser 24 at one end of the lamp is attached to electrical lead 16. The lamp 10 contains a fill material including mercury supplied from dispenser 24 and a rare gas such as argon at a low pressure (e.g., 5 torr).

Figure 4:
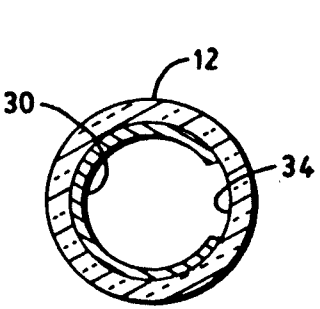
FIG. 4 is a cross-sectional view of the arc discharge lamp of FIG. 1 taken along the lines 4—4 of FIG. 1.
Figure 3:
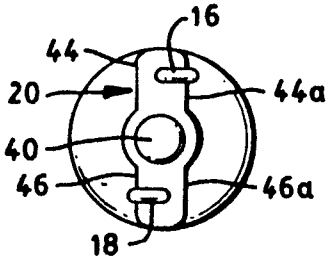
FIG. 3 is an end view of the arc discharge lamp of FIG. 1.
Figure 2:
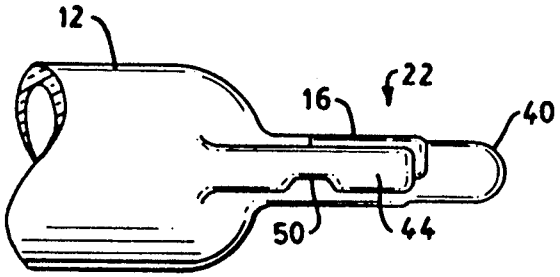
FIG. 2 is a partial view of the arc discharge lamp of FIG. 1 showing one of the press seals.

As illustrated in FIGS. 1 and 4, a coating 30 is applied to the inside surface of envelope 12. Lamp 10 may include an aperture 34 which is formed in layer 30 to direct light from lamp 10 in a preferred direction. As best shown in FIG. 1, the aperture 34 extends axially along a major portion of length of envelope 12 and has a uniform width. The width of aperture 34 depends on the desired radiation pattern from lamp 10. In the case of an aperture fluorescent lamp, layer 30 comprises a reflective layer and a phosphor layer. The reflective layer is first applied to the inside surface of envelope 12 and then the phosphor layer is applied over the reflective layer. The reflective layer has a reflective inside surface. The reflective layer insures that light emitted from the lamp 10 is directed through aperture 34. In an alternative configuration, the reflective layer is removed in aperture 34 but a phosphor layer is applied to the entire inner surface of envelope 12.

In another alternative, aperture 34 and the reflective layer are omitted. In this case, the phosphor layer is uniformly applied to the inside surface of envelope 12, and the lamp provides a uniform cylindrical radiation pattern.

A preferred technique for scraping aperture 34 is described in detail in copending application Ser. No. 07/547,942 (now U.S. Pat. No. 5,116,272 filed Jul. 3, 1990 and assigned to the assignee of the present application.

The press seals 20 and 22 each include a tubulation 40 generally positioned on an axis 42 of envelope 12 and flattened regions 44 and 46 on opposite sides of tubulation 40. Electrical lead 16 extends through and is sealed into flattened region 44, and electrical lead 18 extends through and is sealed into flattened region 46. Flattened regions 44 and 46 include generally flat surfaces 44*a* and 46*a* (FIG. 3), respectively, which are used for orientation of aperture 34. In a preferred embodiment, the surfaces 44*a* and 46*a* are oriented at 90° with respect to a line drawn through the center of aperture 34 and the axis 42 of the envelope 12.

Electrical leads 16 and 18 extend from the end of press seal 20 for connection of the electrode filament 14 to a source of electrical energy. In one configuration as shown, electrical leads 16 and 18 are bent on opposite sides of press seal 20 and extend along the surfaces of flattened regions 44 and 46 respectively. In another configuration, the leads 16 and 18 extend from the end of lamp 10 parallel to axis 42 and can be connected to leads from the electrical source in any convenient manner, such as by crimping.

The press seals 20 and 22 can be provided with means for positioning the baseless lamp 10 of FIG. 1 along axis 42. The positioning means can comprise one or more recesses or detents 50 formed in the press seals 20 and 22. In the example shown in FIGS. 1 and 2, the detents 50 comprise a depression or groove in flattened regions 44 and 46. The groove is oriented with its sides perpendicular to the axis 42 of envelope 12. Thus, when detent 50 engages a projection in the lamp mounting hardware (not shown), the lamp 10 is prevented from moving along axis 42. In a preferred embodiment, one detent 50 is provided on each side of each press seal. Thus, with respect to press seal 20, a detent 50 is located on the front of flattened region 46 and a detent (not shown) is located on the back of flattened region 44. Alternatively, the detents 50 can be replaced with projections which engage corresponding detents in the mounting hardware.

That portion of each electrode filament 14 located between electrical leads 16 and 18 is coated with a quantity of electron-emissive material in order to lower the work function of the cathode and thus improve lamp efficiency. As stated earlier, at the end of the useful life of the lamp, the electron-emissive material on one of the electrode filaments becomes depleted causing the cathode fall voltage to rise by 100 volts or more. If the external circuitry fails to limit the open circuit voltage across the lamp, the lamp may continue to operate with the additional power being deposited at the lamp cathode region. This extra power can lead to excessive local heating of the lamp and fixture.

In accordance with the teachings of the invention, each electrode filament 14 is provided with a pair of ends 26 and 28 (FIG. 1), which extend toward and are in a contiguous relationship with an inside surface of the main body of envelope 12. During normal operation, the heating of electrode filament 14 is confined to those regions of the electrode filament located between electrical leads 16 and 18. Accordingly, little heat is conducted to the glass wall and operation of lamp 10 is unaffected.

It has been discovered that at end-of-life, the heating of an electrode filament depleted of electron-emissive material increases by up to a factor of ten and extends uniformly to the coil ends beyond electrical leads 16 and 18. As a result, a localized hot spot is produced on the glass wall where the electrode filament end touches. This localized heating causes a puncture in the lamp envelope and evacuation of the lamp. The introduction of the external atmosphere into the lamp extinguishes the arc discharge and renders the lamp inoperable.

Figures 5, 6, 7, 8, 9:
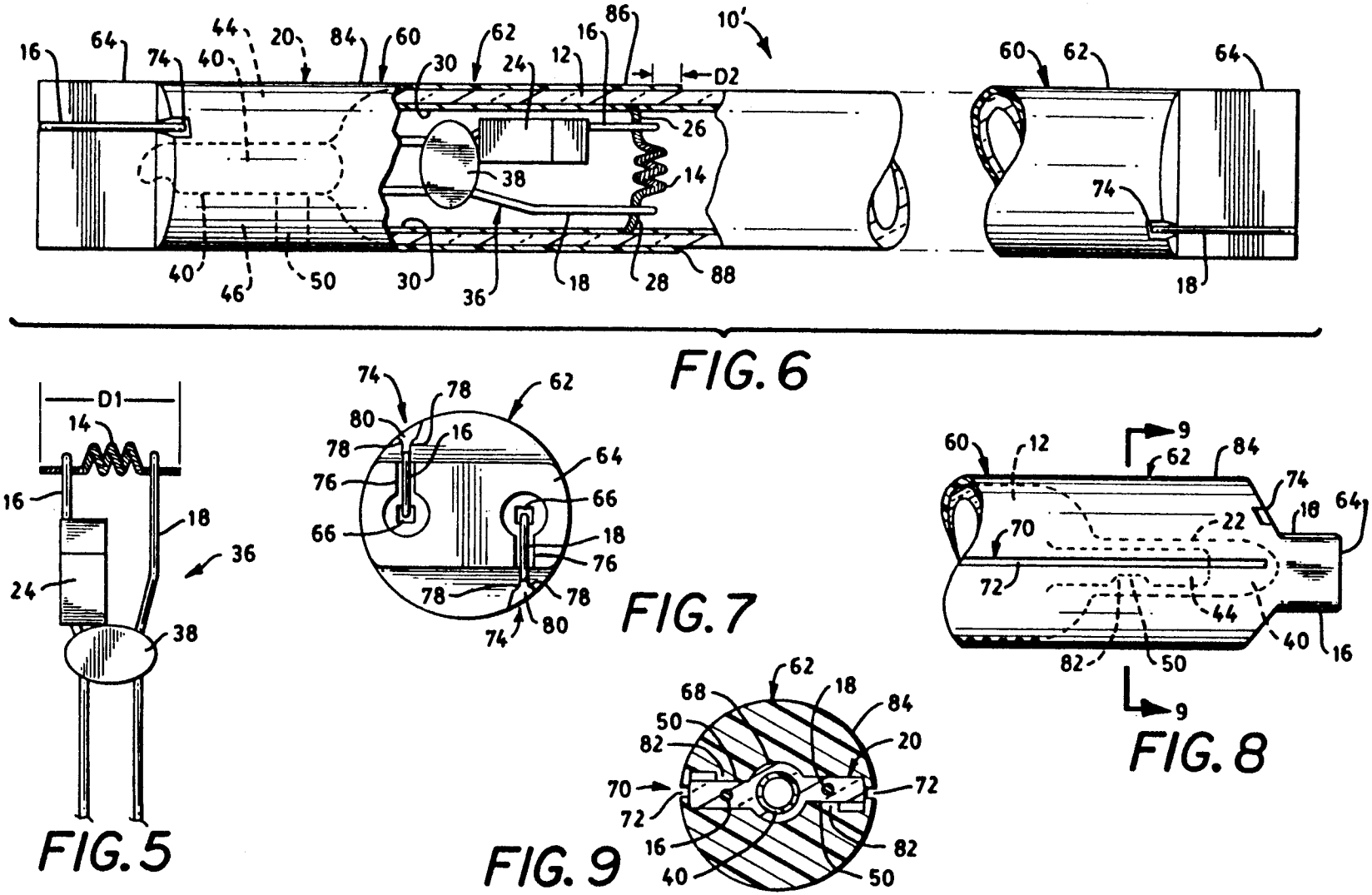
FIG. 5 is a plan view of a mount structure for use in the arc discharge lamp of FIG. 1.
FIG. 6 is a plan view, partially in cross section, of another embodiment of an arc discharge lamp in accordance with the present invention.
FIG. 7 is an end view of the arc discharge lamp of FIG. 6.
FIG. 8 is a partial view of the arc discharge lamp of FIG. 6 showing one of the lamp base members surrounding one of the press seals and a portion of the main body of the lamp.
FIG. 9 is a cross-sectional view of the arc discharge lamp taken along the lines 9—9 in FIG.
Figure 10:
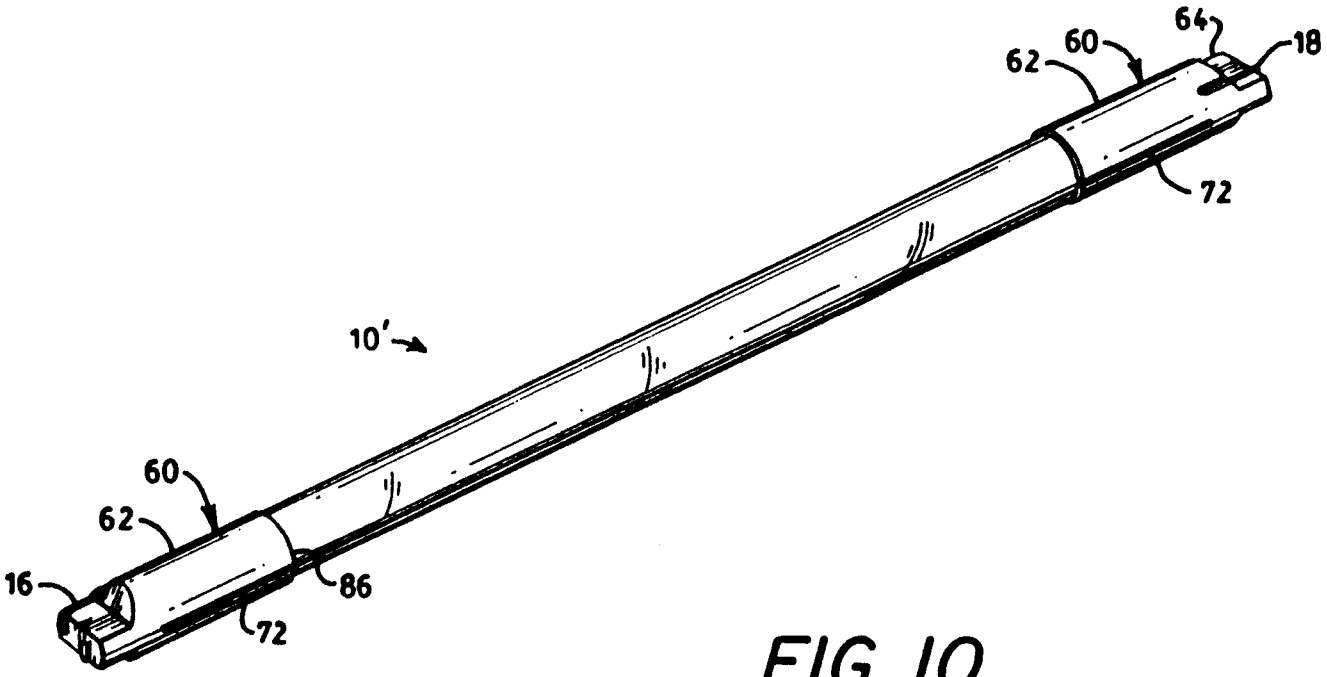
FIG. 10 is a perspective view of the arc discharge lamp of FIG. 6.

FIG. 5 illustrates a mount 36 used in fabricating lamp 10. Mount 36 includes filament 14 supported by electrical leads 16 and 18 which are maintained separated by a conventionally-known glass bead 38. A mercury dispenser 24 is shown secured to electrical lead 16. It is understood that if a dispenser is employed as a means of introducing mercury into the lamp, only one dispenser is required per lamp.

In order to insure that ends 26 and 28 of electrode filament 14 firmly contact the inside surface of envelope 12, the axial length D1 (FIG. 5) of electrode filament 14 is slightly greater than the internal diameter of envelope 12. In a typical example, a subminiature fluorescent lamp having an envelope with an internal diameter of about 5 mm, would typically have a length D1 equal to about 7 mm.

The creation of a puncture in the lamp envelope may, in some instances, result in fracture of the lamp envelope and loss of structural integrity. Referring next to FIGS. 6–8 and 10, there is shown an arc discharge lamp 10′ according to another embodiment of the present invention, wherein similar constituent members as those in FIG. 1 are denoted by the same reference numerals. Lamp 10′ includes an electrically insulating (e.g., plastic) base member 60 secured to each end of the lamp.

Base member 60 is of unitary construction and includes a first portion 62 having a tubular outer shape and a second portion 64 having a flattened shape and protruding from first portion 62. As shown in FIG. 7, a pair of apertures 66 are located within flattened portion 64, each of which extends through flattened portion 64 and is designed for having a respective exteriorly projecting portion of an electrical lead 16, 18 pass therethrough. As further illustrated in FIG. 7, a groove 76 having a predetermined depth is formed in the terminal end of flattened portion 64 for each electrical lead 16, 18. Grooves 76 provide positioning and allow the electrical leads to be flush with the end of the base member.

One end 84 of first base member portion 62 located adjacent flattened portion 64 defines therein an opening 68 (FIG. 9) which is designed for having press seal 20 securedly positioned therein. As shown in FIG. 6, the other end 86 of first portion 62 of the base member defines therein a circular opening 88. End 86 is designed to surround that portion of the lamp envelope adjacent electrode mount structure 36 and, preferably, to extend along the lamp axis and beyond the center of electrode filament 14 by a length D2 (FIG. 6). Typically, distance D2 is equal to about 3/16 inch (4.75 mm). Extending the first base member portion 62 provides support to the lamp envelope in the event that the envelope cracks in the area immediately adjacent the electrode filament ends 26 and 28.

To assist in retaining the base member on arc discharge lamp 10', at least one protruding segment 82 (as illustrated in FIGS. 8 and 9), projects from an internal wall of first base member portion 62. Preferably two such segments are utilized and positioned in a diagonally-opposing relationship as best illustrated in FIG. 9. Each of these protruding segments is designed for being aligned with and subsequently located within a corresponding detent 50 of press seal 20, 22. When one of the press seals of lamp 10' is inserted within a respective base member 60, each of the protruding segments 82 is inserted within a corresponding detent 50, the result being that the press seal is substantially "locked" in position.

To assure positive positioning therein without causing damage to the press seal, the first portion 62 of base member 60 further includes flexure means 70 therein as illustrated in FIGS. 8 and 9 to enable this part of the base member to expand a predetermined amount during said positioning. Flexure means 70 is preferably in the form of two elongated slots 72 formed within first portion 62 to thus enable the first portion to expand radially outwardly during positioning of the press seal within the base member. The press seal is thus firmly positioned within base member 60 without the need for cement or the like.

To maintain the externally projecting portions of electrical leads 16, 18 in proper alignment, base member 60 further includes a plurality of channels 74 (FIGS. 6–8), each located on first portion 62 of the base member adjacent flattened portion 64. Each channel 74 is designed to have one of the terminal ends of a respective electrical lead 16, 18 inserted therein.

As depicted in FIG. 7, each channel 74 includes a tapered portion 80 which facilitates positioning of the substantially annular (round) electrical leads therein. In addition, each channel further includes a narrowed portion formed by a pair of opposing bumps 78 separated a distance which is slightly smaller than the diameter of the electrical lead. Once the terminal end of the electrical lead is forced past bumps 78, the electrical lead is retained and prevented from springing back. In addition to retaining the terminal ends of the electrical leads, bumps 78 provide a reservoir of material which can be mechanically pushed towards the resting electrical lead to more positively retain the electrical lead.

As a result of channels 74, each of the terminal ends of the electrical leads is secured to the base member in a locking relationship to thus prevent subsequent removal thereof during the positioning of each lamp end within a corresponding socket member (not shown). Such retention also serves to assist in maintaining the press seal of lamp 10' firmly within base member 60. A total of two channels are provided on each base member, one for each of the mentioned electrical leads.

There has thus been shown and described an improved arc discharge lamp. The arc discharge lamp includes base members which securely positioned at opposite ends of the lamp without the need for basing cements or the like.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

a light-transmissive envelope having a tubular-shaped main body and a press seal disposed at each end of said main body and including at least one detent formed therein, said main body of said envelope containing a fill material for supporting a low pressure discharge;

a layer of phosphor disposed on a surface within said main body of said envelope;

an electrode filament located at each end of said main body;

a pair of electrical leads attached to each electrode filament and sealed within a respective press seal; and an insulative base member disposed at each end of said lamp, each of said base members including a tubular-shaped first portion having sidewalls and a flattened second portion protruding from one end of said first portion, said one end of said first portion defining a first opening therein for receiving said press seal and having at least one protruding segment within said first opening projecting from an internal wall of said first portion and positioned within said at least one detent of said press seal when said press seal is positioned within said base member so as to assist in retaining said base member, the other end of said first portion of said base member defining an annular-shaped second opening for receiving a portion of said main body of said envelope adjoining said press seal, said first portion of said base member including expansion means therein for enabling said sidewalls of said first portion to expand radially outwardly during positioning of said press seal within said first portion of said base member, said flattened second portion having a pair of apertures each located therewithin for receiving a respective one of said electrical leads from the lamp, said base member including means for maintaining the externally protruding portion of each of said electrical leads in predetermined alignment against a respective external surface of said flattened second portion of said base member.

2. The arc discharge lamp of claim 1 wherein said first portion of said base member extends axially from said press seal and beyond the center of a respective electrode filament.

3. The arc discharge lamp of claim 1 wherein the terminal end of said flattened second portion includes at least one positioning groove formed therein for receiving a portion of one of said electrical leads, said groove having a predetermined depth such that said portion of said electrical lead is flush with said terminal end of said flattened second portion.

4. The arc discharge lamp of claim 1 wherein said terminal end of said flattened second portion includes a pair of positioning grooves formed therein for receiving a portion of a respective electrical lead, each of said grooves having a predetermined depth such that said portion of said electrical led is flush with said terminal end of said flattened second portion.

5. An insulative base member for an arc discharge lamp including a pair of electrical leads supporting an electrode filament and sealed within a press seal disposed at each end of an envelope having a tubular-shaped main body, said base member comprising:

a tubular-shaped first portion having sidewalls and a flattened second portion protruding from one end of said first portion, said one end of said first portion defining a first opening therein for receiving said press seal and having at least one protruding segment within said first opening for positioning within a detent formed in said press seal, the other end of said first portion of said base member defining an annular-shaped second opening for receiving a portion of the main body of the envelope adjoining said press seal, said first portion of said base member including expansion therein for enabling said sidewalls of said first portion to expand outwardly during positioning of said press seal within said first portion of said base member, said flattened second portion having a pair of apertures located therewithin for receiving a respective one of said electrical leads from the lamp, said base member including means for maintaining the externally protruding portion of each electrical lead in predetermined alignment against a respective external surface of said flattened second portion of said base member.

6. The base member of claim 5 wherein the terminal end of said flattened second portion includes at least one positioning groove formed therein for receiving a portion of an electrical lead, said groove having a predetermined depth such that said portion of said electrical lead is flush with said terminal end of said flattened second portion.

7. The base member of claim 5 wherein said terminal end of said flattened second portion includes a pair of positioning grooves formed therein for receiving a portion of a respective one of said electrical leads, each of said grooves having a predetermined depth such that said portion of said electrical lead is flush with said terminal end of said flattened second portion.

* * * * *